US008104384B2

(12) United States Patent
Wilkins et al.

(10) Patent No.: US 8,104,384 B2
(45) Date of Patent: Jan. 31, 2012

(54) SERVICEABLE PIVOT FOR SHEARS

(75) Inventors: Jaret L. Wilkins, Duluth, MN (US); Shane Laurence Bubacz, Duluth, MN (US)

(73) Assignee: Stanley Black & Decker, Inc., New Britain, CT (US)

( * ) Notice: Subject to any disclaimer, the term of this patent is extended or adjusted under 35 U.S.C. 154(b) by 451 days.

(21) Appl. No.: 12/247,446

(22) Filed: Oct. 8, 2008

(65) Prior Publication Data

US 2009/0090009 A1 Apr. 9, 2009

Related U.S. Application Data

(60) Provisional application No. 60/960,648, filed on Oct. 9, 2007.

(51) Int. Cl.
*B02C 1/02* (2006.01)

(52) U.S. Cl. ..... 83/13; 30/134; 241/266

(58) Field of Classification Search ..... 30/134, 30/228; 241/266, 101.73; 72/144, 326, 330; 83/609, 928, 698.11, 13; 144/34.5
See application file for complete search history.

(56) References Cited

U.S. PATENT DOCUMENTS

| | | | | |
|---|---|---|---|---|
| 3,072,448 | A | | 1/1963 | Melton et al. |
| 3,554,588 | A | | 1/1971 | Reinsma et al. |
| 3,869,179 | A | | 3/1975 | Ricca et al. |
| 4,076,345 | A | | 2/1978 | Forster et al. |
| 4,096,957 | A | | 6/1978 | Iverson et al. |
| 4,152,085 | A | | 5/1979 | Brisson |
| 4,398,862 | A | | 8/1983 | Schroeder |
| 4,491,436 | A | | 1/1985 | Easton |
| 4,558,515 | A | * | 12/1985 | LaBounty ..... 30/134 |
| 4,629,353 | A | | 12/1986 | Burke |
| 4,670,983 | A | | 6/1987 | Ramun et al. |
| 4,836,741 | A | | 6/1989 | St. Louis et al. |
| 5,044,812 | A | | 9/1991 | Ardelt et al. |
| 5,060,378 | A | | 10/1991 | LaBounty et al. |
| 5,187,868 | A | * | 2/1993 | Hall ..... 30/134 |
| 5,230,151 | A | * | 7/1993 | Kunzman et al. ..... 30/134 |
| 5,320,443 | A | | 6/1994 | Lien et al. |
| RE35,432 | E | | 1/1997 | LaBounty et al. |
| 5,992,023 | A | | 11/1999 | Sederberg et al. |
| 6,158,917 | A | | 12/2000 | Wolin et al. |
| 6,298,560 | B1 | | 10/2001 | Lee |
| 6,322,280 | B1 | | 11/2001 | Coyne |

(Continued)

OTHER PUBLICATIONS

Stanley LaBounty UP SV Series Universal Processors Brochure, Mar. 2003, 2 pp.

(Continued)

*Primary Examiner* — Phong Nguyen
(74) *Attorney, Agent, or Firm* — Pillsbury Winthrop Shaw Pittman LLP

(57) ABSTRACT

This invention relates to a demolitions shears, including a body having a fixed jaw and a movable jaw that pivots with respect to the fixed jaw. A main shaft for pivotally mounting the moveable jaw to the body. A hydraulic cylinder for actuating the movable jaw to pivot. The movable jaw includes a first rotation stop and the main shaft including a second rotation stop. When the main shaft is installed in the moveable jaw, the first rotation stop and the second rotation stop are coupled to prevent relative rotation between the main shaft and the movable jaw, without axially fixing the main shaft to the movable jaw. A removable stop assembly is constructed and arranged to limit axial movement between the main shaft and the movable jaw.

19 Claims, 4 Drawing Sheets

U.S. PATENT DOCUMENTS

| | | | |
|---|---|---|---|
| 6,926,217 | B1 | 8/2005 | LaBounty et al. |
| 6,976,688 | B2 | 12/2005 | Archer et al. |
| 6,994,284 | B1 | 2/2006 | Ramun |
| 7,108,211 | B2 | 9/2006 | Ramun |
| 7,121,489 | B2 | 10/2006 | Ramun |
| 2004/0228676 | A1 | 11/2004 | Oertley |
| 2005/0199758 | A1 | 9/2005 | Ramun |
| 2006/0005395 | A1 | 1/2006 | Sederberg et al. |
| 2006/0086848 | A1 | 4/2006 | Ramun |

OTHER PUBLICATIONS

Stanley LaBounty MSD Shears MSD7/MSD7R Brochure, Jun. 2001, 2 pp.

* cited by examiner

SERVICEABLE PIVOT FOR SHEARS

CROSS REFERENCE

This application claims the benefit of priority from U.S. Provisional Patent Application Ser. No. 60/960,648, titled "Serviceable Pivot For Shears," filed Oct. 9, 2007, the entire contents of which are hereby incorporated by reference herein.

FIELD OF INVENTION

This invention relates to a shears, in particular, a demolitions shears having an easily removable and serviceable pivot member.

BACKGROUND

Demolition shears employ relatively movable upper and lower jaws, which are structured and configured to cut through metal and other elements between the relatively movable jaws. Shears generally cut along one side of the relatively movable jaws while the workpiece is supported on a guide surface extending along the other side of the jaws.

These shears can be used to cut structures, often large metallic members (e.g., I-beams, channels, angles, sheets, plates, automobile and truck frames, etc.) into smaller or shorter pieces, which can be more easily handled and transported. Demolition shears are usually mounted on the boom structure of a hydraulically powered construction machine, such as a backhoe, and have a hydraulic cylinder attached to one or both jaws to move the jaws relative to each other. See, for example, U.S. Pat. No. 5,992,023, herein incorporated by reference.

The present invention provides an improvement over known demolition shears.

SUMMARY OF INVENTION

According to an aspect of one or more embodiments of the invention, a shears has a body including a fixed jaw, a movable jaw that pivots with respect to the fixed jaw, a hydraulic cylinder for actuating the movable jaw to pivot, a main shaft for pivotally mounting the movable jaw to the body, a rotational coupler that couples the main shaft for rotation with the movable jaw without axially fixing the main shaft to the movable jaw, and a removable stop assembly constructed and arranged to limit axial movement between the main shaft and the movable jaw.

According to a further aspect of one or more of the above embodiments of the invention, the removable stop assembly includes a pair of main bearings for rotationally supporting the main shaft. The removable stop assembly may include a pair of end caps. The removable stop assembly may include a pair of outer thrust washers.

According to a further aspect of one or more of the above embodiments of the invention, the rotational coupler includes a first rotation stop on the movable jaw and a second rotation stop on the main shaft. The removable stop assembly may include an inner thrust washer installed on the main shaft to abut the movable jaw opposite on the side opposite to the first rotation stop.

According to a further aspect of one or more of the above embodiments of the invention, the main shaft is provided with a radially extending shoulder. The first rotation stop may be provided on the shoulder.

According to a further aspect of one or more of the above embodiments of the invention, the moveable jaw includes a bore and a recessed portion surrounding the bore, wherein the second rotation stop is provided on the recessed portion.

According to a further aspect of one or more of the above embodiments of the invention, the shears further includes a tie rod installed through the main shaft and threaded at each end to the end caps.

According to a further aspect of one or more of the above embodiments of the invention, the body includes a pair of spaced apart bosses for supporting the main shaft.

According to a further aspect of one or more of the above embodiments of the invention, the shears includes a cylindrical sleeve installed between the outer surface of the main shaft and a bore of the upper jaw. A main bearing may be attached to each of the pair of bosses by at least one fastener. The end caps may be attached to the main shaft, such that the end caps pivot with the main shaft. The shears may also include a pair of outer thrust washers, wherein each end cap is attached to an end of the main shaft through one of the outer thrust washers.

According to a further aspect of one or more of the above embodiments of the invention, the shears includes a pair of main bearings, each for supporting one end of the main shaft and including a third rotation stop. Each of the pair of bosses includes a fourth rotation stop, such that the third rotation stop and the fourth rotation stop prevent relative rotation between the each of main bearings and its respective boss, without axially fixing the main bearing to the boss.

Another embodiment of the present invention provides a method for using a shears according to any of the above-described embodiments. The method includes detaching a first movable jaw from the shears; and replacing the first movable jaw with a second movable jaw, the second movable jaw having at least one different physical characteristic from the first movable jaw.

Other objects, features, and advantages of one or more embodiments of the present invention will become apparent from the following detailed description, the accompanying drawings, and the appended claims.

BRIEF DESCRIPTION OF THE DRAWINGS

Embodiments of the present invention will now be disclosed, by way of example only, with reference to the accompanying schematic drawings in which corresponding reference symbols indicate corresponding parts, in which.

DETAILED DESCRIPTION OF THE EMBODIMENTS

First Embodiment

Figure 1:
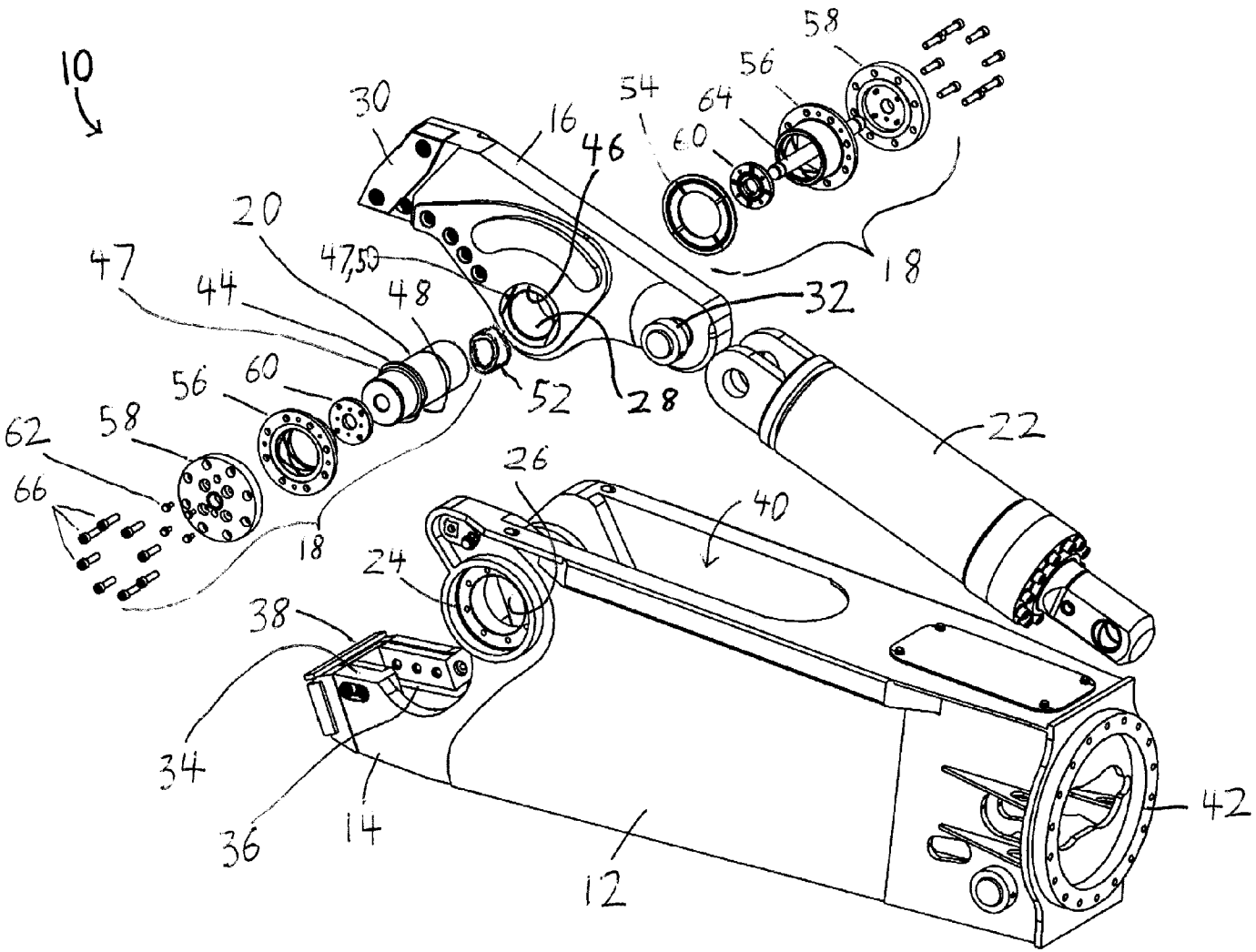
FIG. 1 shows an exploded view of a first embodiment of a demolitions shears, according to the present invention.

FIG. 1 shows an exploded view of a first embodiment of the demolitions shears, according to the present invention. The demolition shears is generally indicated by the numeral 10, and is comprised of a body 12, which includes a fixed lower jaw 14, and a movable upper jaw 16.

While the disclosed embodiments show the fixed jaw as the lower jaw and the movable jaw to the upper jaw of the demolition shears, it is appreciated that the fixed and moveable jaws may be reversed with respect to the body.

A main shaft generally designated by the numeral 20 pivotally supports the upper jaw 16 for mounting upper jaw 16 on the body 12 for relative pivotal movement therebetween. The main shaft 20 rotates together with the movable jaw 16. Movement of the upper jaw 16 is effected by the actuating of a hydraulic cylinder 22, which is secured at one end to the body 12 and at the other end to the upper jaw 16.

The body 12 includes a pair of spaced apart bosses 24 on the right and left hand sides, respectively, each having a bore 26, for supporting one end of the main shaft 20 to the body 12. The lower jaw 14 extends forwardly from the bosses 24.

The upper jaw 16 includes a bore 28 therethrough for accepting the main shaft 20, and a nose portion 30 extending forwardly from the bore 28. A connection 32, such as a bearing, may be provided at the rear portion of the upper jaw for pivotally coupling with one end of the hydraulic cylinder 22. Similarly, a rear inside portion of the body 12 may be provided with similar connection (not shown) for pivotally coupling with the other end of the hydraulic cylinder 22.

The lower jaw 14 has pair of cutter sidewalls 34, defining an upwardly opening recess 36 and a nose portion 38 extending forward of the sidewalls 34. When the upper jaw 16 is the closed position, it enters the recess 36 of the lower jaw 14.

The upper and lower jaws 16, 14 each have a piercing/cutting edge provided at their nose portions 30, 38. The lower jaw 14 further may include pair side cutting edges on the sidewalls 34. The piercing/cutting edges and side cutting edges may be fabricated from a hard and/or abrasive material for piercing through and/or cutting metal. Further, because the piercing/cutting edges and side cutting edges become worn during use, they may be defined by detachable blade insert members that are releasably attached, for example, with fasteners to the upper and lower jaws 16, 14 to facilitate their replacement.

The body 12 and the lower jaws 14 are formed of heavy-duty metal, and may be generally fabricated as cast structures or welded from metal plate. The upper jaw 16 may be fabricated from metal plate.

The body 12 includes a recessed portion 40 for accommodating the hydraulic cylinder 22 and the upper jaw 16. As will be readily appreciated, the upper jaw 16 is configured and dimensioned so that it will fit easily into and pivot within the recessed portion 40 of the body 12. Further, the rear portion of the body 12 may include a mounting portion 42, for attaching the demolitions shears 10 to a construction vehicle (not shown), with bolts or other fasteners.

A removable stop assembly 18 is provided for axially fixing the main shaft with respect to the upper jaw 16 and the bosses 24 of the body 12. The removable stop assembly 18 may include, but is not necessarily limited to: an inner thrust washer 54; a pair of outer thrust washers 60; a pair of main bearings 56; a pair of end caps 58 and a tie rod 64. Additional elements, e.g., a shim, may also be provided.

Each of the pair of main bearings 56 are installed into one the bosses 24 of the body 12 for rotationally supporting an end of the main shaft 20. The main bearings 56 have a cylindrical portion and a radially extending flange. The cylindrical portion of the main bearing 56 is inserted externally into each of the left and right bosses 24 so that the radially extending flange abuts the outer surface of the left and right bosses 24, respectively. The main bearings 56 may be a plain bearing formed of and/or coated with a low friction bearing material, such as an aluminum bronze bearing.

In one embodiment, a cylindrical sleeve 52 may also be provided in the bore 28 of the upper jaw 16. The sleeve 52 allows for easy reconditioning of the bore 28 of the upper jaw 16 without re-machining.

The main shaft 20 may be melonited or otherwise plated to provide corrosion resistance and/or to cause the contacting surfaces of the main shaft 20 and the bore 28 to be dissimilar metals so as to reduce seizing/binding.

With the upper jaw 16 installed in the body 12 and the main bearing 56 installed in the bosses, the main shaft 20 is "clearance fit" into the left and right bosses 26 of the body 12 and the bore of the upper jaw 16. The outer diameter of the main shaft is slightly smaller than the inner diameter of the bore 28 of upper jaw 16 (or cylindrical sleeve 52, if used). The "clearance fit" allows the main shaft 20 to slide easily into the bore 28 of the upper 16 with relatively little or no friction or resistance. While reference is made to the main shaft 20 sliding into the bore 28, it is understood that main shaft 20 may also be slid into the bore of the cylindrical sleeve 52 in a similar manner.

In FIG. 1, the main shaft 20 is shown installed from the left hand side of the body 12 with the recessed portion 46 provided on the left side of the upper jaw 16. However, it will be appreciated that the main shaft 20 may also be inserted from the right side, with the recessed portion 46 provided on the right side of the upper jaw 16.

The main shaft 20 is provided with a radially extending shoulder 44. When the main shaft 20 is installed in the bore 28 of the upper jaw 16, the shoulder 44 abuts a side surface of the upper jaw 16 to resist lateral movement during cutting. In one embodiment, the left side of the upper jaw 16 may be provided with the recessed portion 46 surrounding the bore 28 of the upper jaw 16 for abutment with the shoulder 44 of the main shaft 16. However, the demolitions shears 10 may be similarly configured with the recessed portion 46 on the right side of the jaw 16.

In order to make the main shaft 20 rotationally coupled for rotation with the upper jaw 16, a rotational coupler 47 is provided that rotationally couples the two parts, but does not permanently fix them together. In one embodiment, the rotational coupler comprises a first rotation stop 48 provided on the main shaft 20 and a second rotation stop 50 provided on the upper jaw 16. However, any interengaging arrangement of surfaces between the upper jaw and main shaft can be used for the rotational coupler 47, and the disclosed arrangement is but one example. It will be appreciated that the first and second rotation stops 46, 50 may include a key, spline, tongue and groove, flats, or any other non-circular feature, that may prevent relative rotation therebetween. In addition, the coupler 47 can be a direct engagement between the main shaft and the upper or movable jaw, or it can comprise additional structural elements for achieving the rotational engagement. The engagement is such that the movable jaw and shaft do not bind to one another and are not crimped to one another, so that they can be axially separated by simply disengaging or unfastening an axially limiting stop structure, such as end caps as will be described. In the embodiments shown in FIGS. 1-3, the rotation stops 48 comprise a pair of rotation flats provided on the shoulder 44 of the main shaft 20 and the rotation stops 50 comprise a pair of complementary rotation flats provided on the recessed portion 46 of the upper jaw 16. When the main shaft 20 is installed into the bore 28 of the upper jaw 16, the first and second rotation stops 48, 50 are coupled to prevent the relative rotation there between.

This configuration allows that the main shaft 20 to be easily removable from the bore 28 of the upper jaw 16. As such, the main shaft 20 and the upper jaw 16 are rotationally fixed, but not axially fixed, with respect to each other. No thermal process nor substantial force is necessary to remove the main shaft 20 from the bore 28 of the upper jaw 16. It simply slides from the upper jaw 16 with relatively ease.

The inner thrust washer 54 may be provided over the right side of the main shaft 20, between the right main bearing 56 and the right side (opposite the recessed portion 46) of the upper jaw 16. The inner thrust washer 54 abuts the right side of the upper jaw 16 and prevents lateral movement of the upper jaw 16 toward the right hand side and wear of the upper jaw during operation. Alternatively, if the upper jaw 46 is configured such that the recessed portion 46 is provided on the right side surface of the upper jaw 16, then the inner thrust washer 54 may be provided on the left side of the main shaft 20 to abut the left side of the upper jaw 16.

Figure 4:
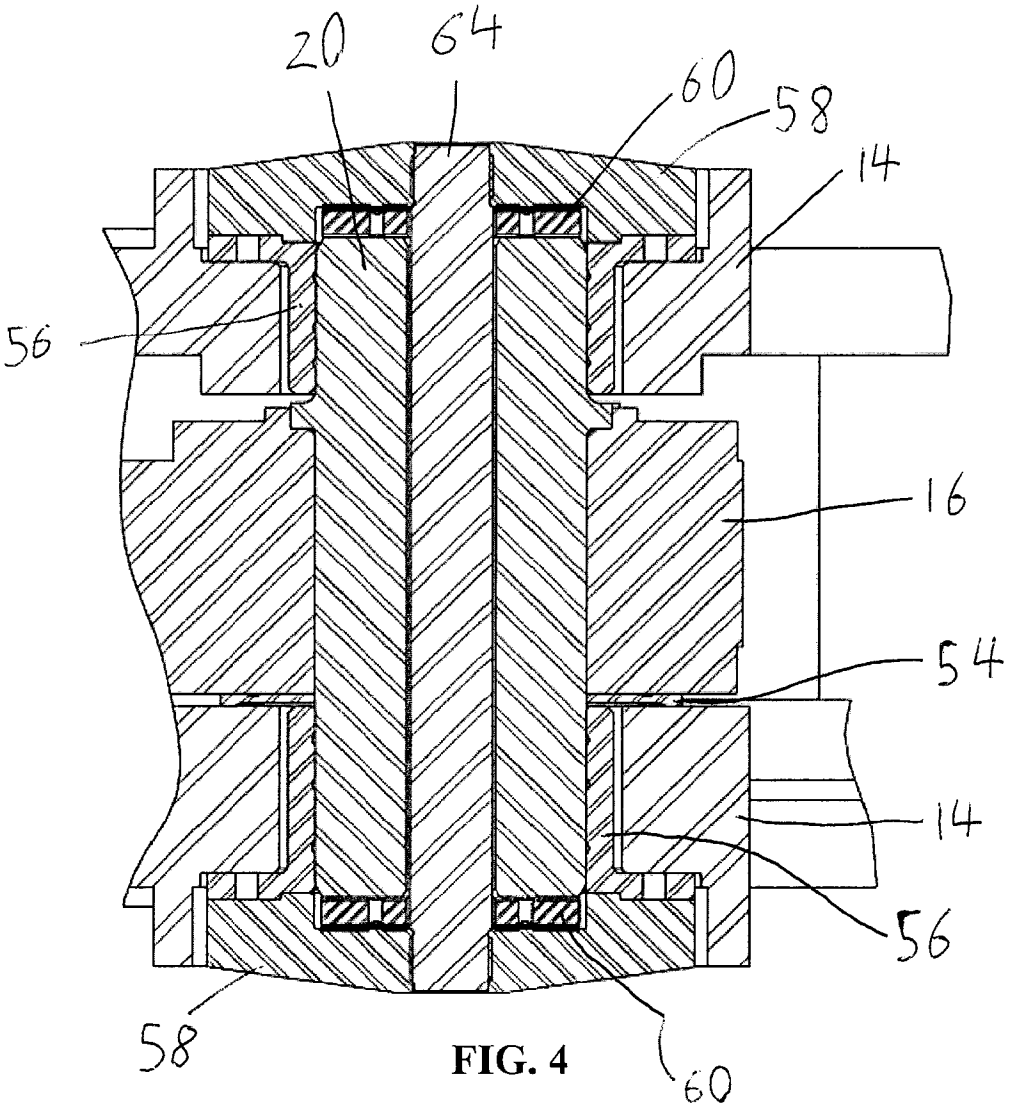
FIG. 4 shows an enlarged cross-sectional view of the pivot assembly of the demolitions shears of FIG. 1, when assembled.

The tie rod 64 may be installed through the main shaft 20 and is threaded on both its ends. Next, left and right end caps 58 are installed over each end of the main shaft 20 to cover the main bearings 56. The bosses 24 may include recessed portions such that when the end caps 58 are assembled, they are generally flush with the bosses 24, as shown in FIG. 4. Each of right and left end caps 58 are threaded onto the tie rod 64, respectively. The tie rod 64 joins both sides of the body 12 and helps to withstand cutting forces that tend to force the upper jaw 16 to the left hand and right hand sides.

On the inside surface of each of the end caps 58, an outer thrust washer 60 is fastened to the end cap 58 by a set of fasteners 62. The outer thrust washers 60 maintain the lateral position of the main shaft 20, transfer lateral force to the end caps 58, and wear as the upper jaw 16 and main shaft 20 pivot. In that regard, the outer thrust washers 60 may easily be replaced, by removing the end caps 58.

Right and left end caps 58 are fastened by a set of fasteners 66 through the main bearings 56 and into corresponding mounting holes encircling the respective left and right bosses 24 of the body 12. The end cap fasteners 66 prevent the main bearings 20 and end caps 58 from rotating as the upper jaw 16 pivots. Further, the end caps 58 help to resist the left and right lateral forces generated during cutting.

FIG. 4 shows a cross-sectional view of the demolition shears 10 taken along the main shaft 20, shows the demolitions shear 10, as assembled.

Second Embodiment

Figure 2:
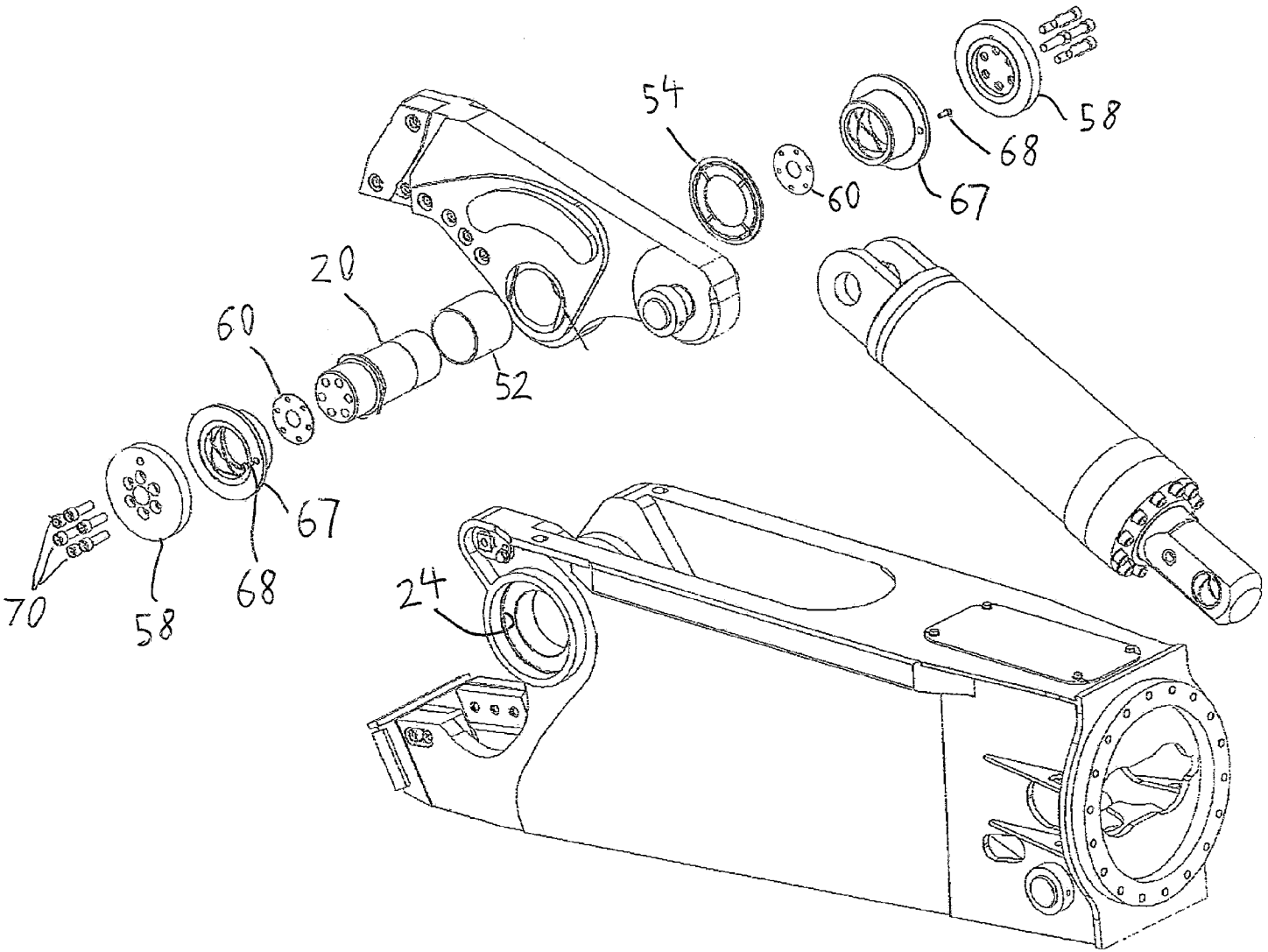
FIG. 2 shows an exploded view of a second embodiment of the demolitions shears.

FIG. 2 shows an exploded view of a second embodiment of the demolitions shears 10 according to the present invention. The tie rod 64 of the first embodiment has been removed as well as some of the fasteners attaching the end caps 58 to the left and right bosses 24 of the body 12. Also, the end caps 58 rotate along with the main shaft 20 and upper jaw 16 as they pivot.

The ends surfaces of the main shaft 20 may be provided with a plurality of mounting holes. The main bearings 56 are installed into the boss of the pivot portion of the body. The rotation of each of the main bearings 56 and each boss 24 is prevented by at least one fastener 68, for example, a bolt.

Rather than having the end caps 58 directly attached to the left and right bosses 24, as in first the embodiment, the end caps 58 are attached through the outer thrust washers 60 to the main shaft 20, by a plurality of fasteners 70.

The outer thrust washers 60 transfer lateral force to the end caps 58 and wear as the upper jaw 16 and main shaft 20 rotate. The inner thrust washer 54 on the right hand side of the upper jaw 16 helps prevent lateral movement of the upper jaw 16 toward the right hand side during cutting. The end caps 58 are attached to the main shaft 20 through the outer thrust washers 60 and rotate with the main shaft 20. The end cap fasteners 70 help to resist the left and right lateral forces generated during cutting that try to force the upper jaw 16 toward the left hand and right hand sides.

Third Embodiment

Figure 3:
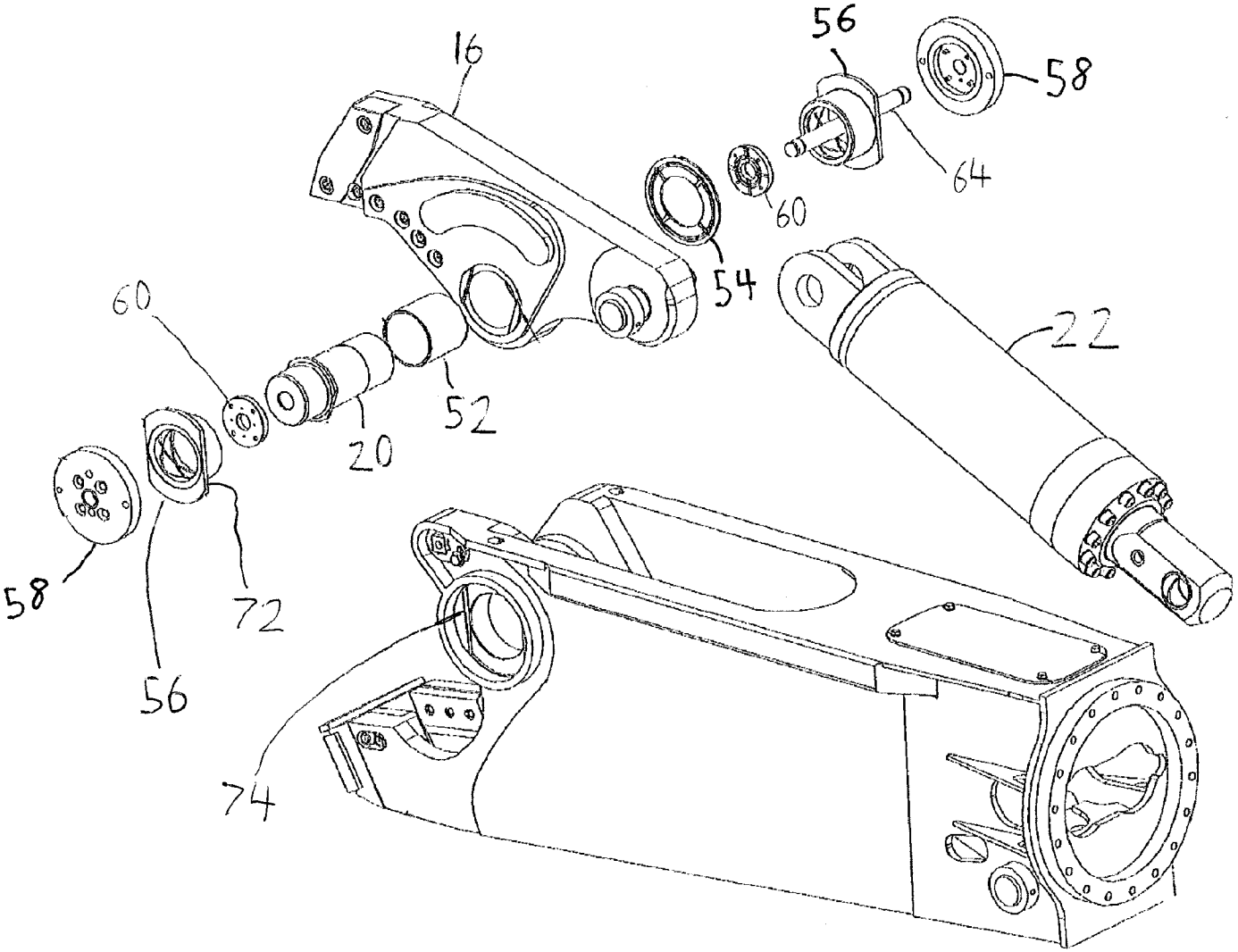
FIG. 3 shows an exploded view of a third embodiment of the demolitions shears.

FIG. 3 shows an exploded view of a third embodiment of the demolitions shears 10 according to the present invention. In this embodiment, the relative rotation of the main bearings 56 and the body 12 is prevented by providing complementary rotation stops on the main bearings 56 as well as the left and right boss 24.

A third rotation stop 72 is provided on each of the main bearing 56 and a fourth rotation stop 74 is provided each of the bosses 24. When the main bearing 56 are installed into the right and left bosses 24 of the body 12 the third and fourth rotation stops 72, 74, are coupled to prevent the relative rotation there between. In the embodiment shown in FIG. 3, the third rotation stop 72 comprises a pair of rotation flats provided on each of the radially extending flanges of the main bearings 56 and the fourth rotation stop 74 comprises a pair of rotation flats provided proximate to bore 26 in each of the bosses 24. It will be appreciated that the third and fourth rotation stops 72, 74 may include a key, spline, tongue and groove, flats, or any other non-circular feature, that may prevent relative rotation there between.

The outer thrust washers 60 are attached to the end caps 58 by a set of fasteners 62 (shown in FIG. 1). The thrust washers 60 transfer lateral force to the end caps 58 and wear as the upper jaw 16 and main shaft 20 rotate. The inner thrust washer 54 on the right hand side of the upper jaw 16 helps prevent lateral movement of the upper jaw 16 towards the right hand side during cutting. The tie rod 64 is installed through the main shaft 20 and has a threaded end joined to each end cap 58. The tie rod 64 helps to withstand cutting forces that tend to force the upper jaw 16 to the left hand and right hand side and the bosses 24 further apart.

The above-disclosed embodiments are improvements over the conventional pivot assembly for demolitions shears. The main shaft 20 may easily be removed from the upper jaw 16, simply by disassembling the removable stop assembly 18 and sliding the main shaft 20 from the bore 28 of the upper jaws 16.

The serviceable pivot according to one or more embodiments of the present invention facilitates alternating between two or more different upper jaws 16 that can be used with the shears 10. Such alternative upper jaws may be identical to each other to facilitate replacement of a worn or broken jaw, or may have at least one physical difference. For example, while the upper jaw 16 illustrated in FIG. 1 utilizes a replaceable, indexable nose portion 30, the serviceable pivot may facilitate replacing this upper jaw 16 with an upper jaw with a weld-in nose portion such as that shown in FIG. 1 of U.S. Pat. No. 5,992,023, the entire contents of which are hereby incorporated herein by reference. Similarly, the upper jaw 16 may be replaced with a lubricated jaw such as those shown in FIGS. 20-31 of U.S. Patent Application Publication No. 2006-0005395 A1, the entire contents of which are hereby incorporated herein by reference. Additional upper jaws may also be provided (e.g., a concrete cracking jaw, a concrete pulverizing jaw). Lower blade insert members that are tailored to matching upper jaws may be mounted to the lower jaw (e.g., in place of the existing lower blade insert members). Such jaws are preferably constructed with appropriate bores, stops, etc., as explained above, so that they can be used with the serviceable pivot. Such replaceability enables a single shears 10 to be used in a variety of different ways by switching the upper jaw for another type of upper jaw, thereby making the shears 10 more versatile. The serviceable pivot preferably facilitates switching between different upper jaws in the field in a relatively short amount of time.

While this invention has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the invention following, in general, the principles of the invention and including such departures from the present disclosure as come within known or customary practice in the art to which the invention pertains, and as may be applied to the essential features hereinbefore set forth and followed in the spirit and scope of the appended claims.

What is claimed is:

1. A method of using a shears, the shears comprising:

a body including a fixed jaw;

a first movable jaw that pivots with respect to the fixed jaw;

a hydraulic cylinder for actuating the first movable jaw to pivot;

a main shaft for pivotally mounting the first movable jaw to the body;

a rotational coupler that couples the main shaft for rotation with the first movable jaw without axially fixing the main shaft to the first movable jaw; and a removable stop assembly constructed and arranged to limit axial movement between the main shaft and the first movable jaw, the method comprising:

detaching the first movable jaw from the shears; and replacing the first movable jaw with a second movable jaw, the second movable jaw having at least one different physical characteristic from the first movable jaw wherein before said detaching of the first movable jaw from the shears, the rotational coupler prevents the main shaft from rotating relative to the first movable jaw.

2. A shears, comprising:

a body including a fixed jaw, wherein the body includes a pair of spaced apart bosses;

a movable jaw that pivots with respect to the fixed jaw;

a hydraulic cylinder for actuating the movable jaw to pivot;

a main shaft for pivotally mounting the movable jaw to the body, wherein the spaced apart bosses support the main shaft;

a rotational coupler that couples the main shaft for rotation with the movable jaw without axially fixing the main shaft to the movable jaw;

a removable stop assembly constructed and arranged to limit axial movement between the main shaft and the movable jaw; and a pair of main bearings, each for supporting one end of the main shaft and including a third rotation stop, wherein each of the pair of bosses includes a fourth rotation stop, such that the third rotation stop and the fourth rotation stop prevent relative rotation between the each of main bearings and its respective boss, without axially fixing the main bearing to the boss.

3. A shears, comprising:

a body including a fixed jaw;

a movable jaw that pivots with respect to the fixed jaw;

a hydraulic cylinder for actuating the movable jaw to pivot;

a main shaft for pivotally mounting the movable jaw to the body;

a rotational coupler that couples the main shaft for rotation with the movable jaw without axially fixing the main shaft to the movable jaw; and a removable stop assembly constructed and arranged to limit axial movement between the main shaft and the movable jaw wherein the rotational coupler prevents the main shaft from rotating relative to the movable jaw.

4. The shears according to claim 1, wherein the removable, stop assembly comprises a pair of main bearings for rotationally supporting the main shaft.

5. The shears according to claim 1, wherein the removable stop assembly comprises a pair of end caps.

6. The shears according to claim 5, further comprising a tie rod installed through the main shaft and threaded at each end to the end caps.

7. The shears according to claim 1, wherein the removable stop assembly comprises a pair of outer thrust washers.

8. The shears according to claim 1, wherein the rotational coupler comprises a first rotation stop on the movable jaw and a second rotation stop on the main shaft.

9. The shears according to claim 8, wherein the removable stop assembly comprises an inner thrust washer installed on the main shaft to abut the movable jaw opposite on the side opposite to the first rotation stop.

10. The shears according to claim 3, wherein the main shaft is provided with a radially extending shoulder.

11. The shears according to claim 10, wherein:

the rotational coupler comprises a first rotation stop on the movable jaw and a second rotation stop on the main shaft; and the first rotation stop is provided on the shoulder.

12. The shears according to claim 11, wherein the moveable jaw includes a bore and a recessed portion surrounding the bore, wherein the second rotation stop is provided on the recessed portion.

13. The shears according to claim 3, wherein the body includes a pair of spaced apart bosses for supporting the main shaft.

14. The shears according to claim 3, further comprising a cylindrical sleeve installed between the outer surface of the main shaft and a bore of the upper jaw.

15. The shears according to claim 13, wherein a main bearing is attached to each of the pair of bosses by at least one fastener.

16. The shears according to claim 15, wherein the end caps are attached to the main shaft, such that the end caps pivot with the main shaft.

17. The shears according to claim 15, further comprising a pair of outer thrust washers, wherein each end cap is attached to an end of the main shaft through one of the outer thrust washers.

18. The shears according to claim 3, further comprising a second movable jaw that may be attached to the shears, in place of the movable jaw, wherein the movable jaw and second movable jaw comprise at least one different physical characteristic from each other.

19. The shears of claim 3, wherein distal portions of the main shaft are supported by the fixed jaw, and a central portion of the main shaft supports the movable jaw.

* * * * *